US007524252B2

(12) United States Patent
Endo et al.

(10) Patent No.: US 7,524,252 B2
(45) Date of Patent: Apr. 28, 2009

(54) GOLF BALL

(75) Inventors: Kiyoshi Endo, Osaka (JP); Toshiyuki Tarao, Kobe (JP)

(73) Assignees: SRI Sports Limited, Kobe-shi (JP); Endo, Kiyoshi, Osaka (JP)

( * ) Notice: Subject to any disclaimer, the term of this patent is extended or adjusted under 35 U.S.C. 154(b) by 0 days.

(21) Appl. No.: 11/822,106

(22) Filed: Jul. 2, 2007

(65) Prior Publication Data

US 2008/0015052 A1 Jan. 17, 2008

(30) Foreign Application Priority Data

Jul. 4, 2006 (JP) ..... 2006-184880

(51) Int. Cl.
*A63B 37/00* (2006.01)

(52) U.S. Cl. ..... 473/351

(58) Field of Classification Search ..... 473/351
See application file for complete search history.

(56) References Cited

U.S. PATENT DOCUMENTS 5,782,702 A * 7/1998 Yamagishi et al. ..... 473/280
6,489,401 B2 12/2002 Endo et al.
6,692,381 B2 2/2004 Sakagami et al.
2006/0094832 A1 * 5/2006 Sakagami et al. ..... 525/343

FOREIGN PATENT DOCUMENTS

JP 2002-35167 A 2/2002
JP 2002-282393 A 10/2002
JP 2002-338737 A 11/2002

OTHER PUBLICATIONS

Kiyosho Endo et al., 1,4 Cis Selectivity and Molecular Weight COntrol of Polymer in the Polymerization of 1,3-Butadiene with Metallosalen Complexes/Methylaluminoxane Catalysts, 2005, e-journal.*

* cited by examiner

*Primary Examiner*—Raeann Trimiew
(74) *Attorney, Agent, or Firm*—Birch, Stewart, Kolasch & Birch, LLP

(57) ABSTRACT

The object of the present invention is to improve the resilience and the durability of the golf ball to be obtained by reducing the content of trans-1,4-bond in a one-piece golf ball using a polybutadiene having a high content of cis-1,4-bond. The one-piece golf ball of the present invention is obtained by molding a rubber composition containing (a) a base rubber containing a polydiene obtained by polymerizing diene in the presence of a catalyst containing a metallosalen complex and aluminoxane, (b) a co-crosslinking agent, and (c) a crosslinking agent.

7 Claims, 2 Drawing Sheets

GOLF BALL

BACKGROUND OF THE INVENTION

1. Field of the Invention

The present invention relates to a one-piece golf ball, more particularly to a technology for improving the resilience and durability of a rubber composition used for the one-piece golf ball.

2. Description of the Related Art

The one-piece golf ball consisting of a single layer is generally a spherical molded body of a rubber composition containing a base rubber, a co-crosslinking agent and a crosslinking agent. The characteristics of a golf ball such as resilience and durability are highly affected by the rubber composition constituting the one-piece golf ball. For example, the high resilience provides the golf ball with the long distance when hit, and the high durability suppresses the generation of cracks when the golf ball was used repeatedly. Since the one-piece golf ball consists of 100% rubber composition, the one-piece golf ball is affected more significantly by a rubber composition, especially a base rubber contained in the rubber composition, compared with multi-piece golf balls such as a two-piece golf ball and a three-piece golf ball. Thus the improvement of the rubber composition has been under investigation in order to improve the characteristics of the golf ball.

For example, Japanese patent publication No. 2002-282393A discloses a polybutadiene with 99% or more of cis-1,4-bond synthesized using a catalyst consisting of a composition which comprises a metallocene catalyst of a rare-earth metal compound, an ionic compound consisting of an uncoordinated anion and a cation, and/or aluminoxane. Japanese patent publication No. 2002-338737A discloses a polybutadiene with 80% or more of cis-1,4-bond having a molecular weight distribution (Mw/Mn) of 1.2 to 2.0 synthesized using a catalyst consisting of a composition which comprises a metallocene catalyst of a rare-earth metal compound, an ionic compound consisting of an uncoordinated anion and a cation, and/or aluminoxane. Additionally, Japanese patent publication No. 2002-35167A discloses a one-piece golf ball consisting of the rubber composition containing two-kinds of the polybutadienes having a specific molecular weight in a specific mixing ratio.

However, in a technology wherein the metallocene catalyst is used to enhance the content of cis-1,4-bond, there exists a problem that it is unsuitable for industrial use since the metallocene catalyst is unstable in the air. In addition, the resilience and durability of the golf ball is not improved sufficiently by merely adjusting the molecular weight of the polybutadiene rubber, and thus there is a need for the further improvement. Further, the polybutadiene has bonding types such as trans-1,4-bond and 1,2-vinyl bond other than cis-1,4-bond, and it is known that the high content of trans-1,4-bond before the crosslinking lowers the resilience.

SUMMARY OF THE INVENTION

The present invention has been achieved in view of the above circumstances, and the object of the present invention is, in a one-piece golf ball using a polydiene containing a high content of cis-1,4-bond as a base rubber, to improve the resilience and the durability of the resultant one-piece golf ball by lowering the content of trans-1,4-bond.

A one-piece golf ball of the present invention that has solved the above problem is a golf ball obtained by molding a rubber composition which comprises (a) a base rubber containing a polydiene obtained by polymerizing a diene in the presence of a catalyst containing a metallosalen complex and aluminoxane;

(b) a co-crosslinking agent; and (c) a crosslinking agent.

The gist of the present invention resides in using the polydiene obtained by polymerizing the diene in the presence of the catalyst containing the metallosalen complex and aluminoxane, as the base rubber of the rubber composition constituting the one-piece golf ball. By polymerizing the diene in the presence of the catalyst containing the metallosalen complex and the aluminoxane, the content of trans-1,4-bond can be reduced to 1% or less while the content of cis-1,4-bond can be increased to 90% or more, in the resultant polydiene. As the result, the resilience and the durability of the resultant golf ball are improved by using the above polydiene as the base rubber.

Preferred examples of the diene include 1,3-butadiene, 2-methyl-1,3-butadiene, 2-ethyl-1,3-butadiene, 2,3-dimethyl-1,3-butadiene, 1,3-pentadiene, 2-methyl-1,3-pentadiene, 4-methyl-1,3-pentadiene and 2,4-hexadiene, more particularly 1,3-butadiene.

Examples of the metal of the metallosalen complex include nickel, cobalt, iron, titanium and vanadium. As the catalyst, a catalyst consisting of a cobalt salen complex and methylaluminoxane is preferably used.

The present invention provides a one-piece golf ball which is excellent in resilience and durability.

DESCRIPTION OF THE PREFERRED EMBODIMENT

Figure 1:
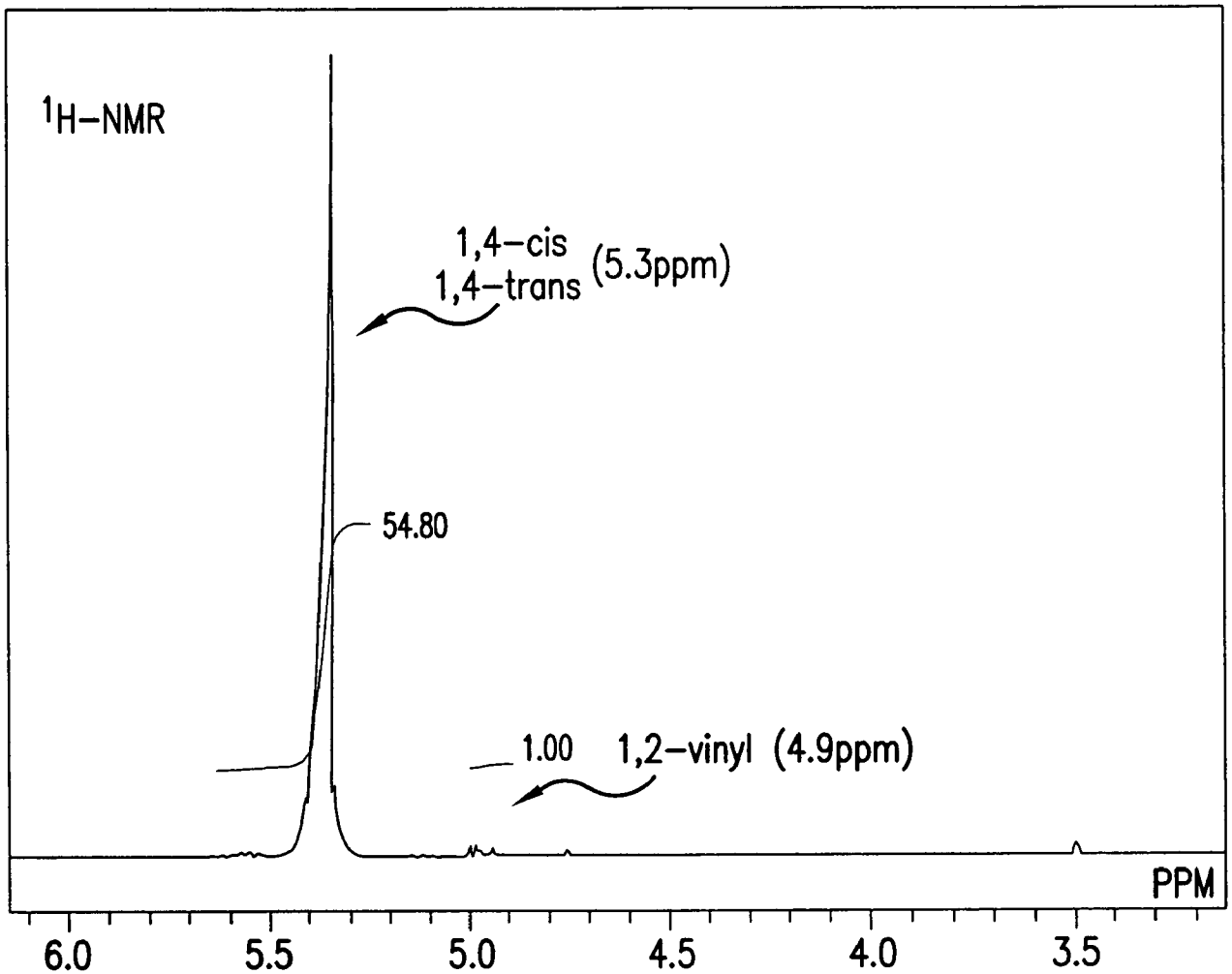
FIG. 1 is a $^{1}$H-NMR chart showing an example of the polybutadiene.

The one-piece golf ball of the present invention is obtained by molding a rubber composition which comprises:

(a) a base rubber containing a polydiene obtained by polymerizing a diene in the presence of a catalyst containing a metallosalen complex and aluminoxane;

(b) a co-crosslinking agent; and (c) a crosslinking agent.

First, an explanation of (a) the base rubber containing the polydiene obtained by polymerizing the diene in the presence of the catalyst containing the metallosalen complex and aluminoxane (hereinafter occasionally referred to as "high-cis/low-trans polydiene") will be provided.

The metallosalen complex is a complex consisting of a salen ligand [N,N'-bis(salicyldene)ethylenediamine] or a derivative thereof and a metal, for example, expressed by the following chemical formula (1) or (2):

(1)

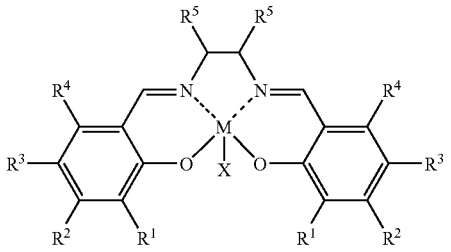

-continued (2)

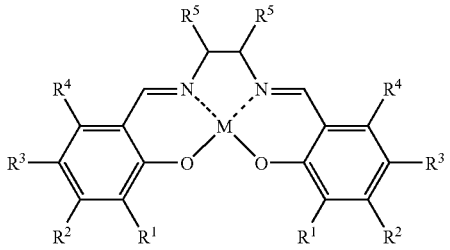

In the formula, $R^1$, $R^2$, $R^3$, and $R^4$ may be either same or different, and are an alkyl group having 1 to 10 carbon atoms (preferably an alkyl group having 1 to 4 carbon atoms), one in which a part of hydrogen thereof is substituted with halogen, or hydrogen. More preferably, $R^1$ or both $R^1$ and $R^3$ are an alkyl group having 1 to 10 carbon atoms (preferably an alkyl group having 1 to 4 carbon atoms), wherein $R^2$ and $R^4$ are hydrogen. $R^5$ is an alkyl group having 1 to 10 carbon atoms or one in which a part of hydrogen thereof is substituted with halogen, a phenyl group or one in which a part of hydrogen thereof is substituted with halogen, or hydrogen, and further, the neighboring two $R^5$ may form a benzene ring or a cyclohexyl ring. M is a metal and X is an anion.

The salen ligand is synthesized by a dehydration-condensation reaction of a corresponding salicylaldehyde and a derivative of ethylenediamine.

Examples of the corresponding salicylaldehyde include salicylaldehyde, 2-hydroxy-3,5-dimethyl benzaldehyde, 2-hydroxy-5-methyl benzaldehyde, 5-tert-butyl-2-hydroxy benzaldehyde and 3,5-di-tert-butyl-2-hydroxy benzaldehyde. Examples of the ethylenediamine derivative include 1,2-ethane diamine, 1,2-benzene diamine, 1,2-cyclohexane diamine such as (1R,2S)-1,2-cyclohexane diamine, (1S,2S)-1,2-cyclohexane diamine, (1R,2R)-1,2-cyclohexane diamine or trans-1,2-cyclohexane diamine.

The metal of the metallosalen complex is not particularly limited. Examples of the metal include nickel, cobalt, iron, titanium and vanadium, and cobalt is particularly preferred.

Examples of the anion X of the metallosalen complex include anions such as a hydroxide ion ($OH^-$); a halonium such as chloride ion ($Cl^-$), a bromide ion ($Br^-$) and a fluoride ion ($F^-$); an acetate ion ($CH_3COO^-$); a nitrate ion ($NO_3^-$); a sulfate ion ($SO_4^{2-}$), an oxalate ion ($C_2O_4^{2-}$); a phosphate ion ($PO_4^-$) and a hexa-fluorophosphate ion ($PF_6^-$). In the present invention, a metallosalen complex devoid of anion X as represented by the formula (2) can be used.

As the metallosalen complex, N,N'-bis(3-tert-butylsalicylidene)ethylenediaminato Cobalt(II) (Formula(3)), N,N'-bis(3-tert-butyl-5-methylsalicylidene)ethylenediaminato Cobalt(II) (Formula (4)), N,N'-bis(3,5-di-tert-butylsalicylidene)ethylenediaminato Cobalt(II) (Formula (5)) N,N'-bis(3,5-di-tert-butylsalicylidene)1,2-diphenylethylenediaminato Cobalt(II) (Formula (6))and the like are particularly preferred.

(3)

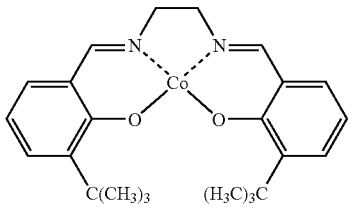

-continued (4)

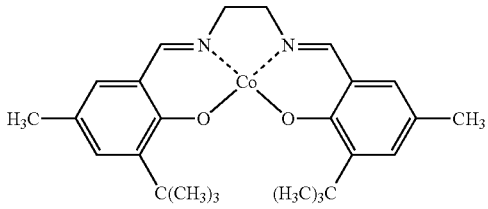

(5)

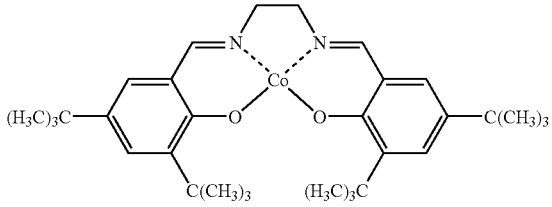

(6)

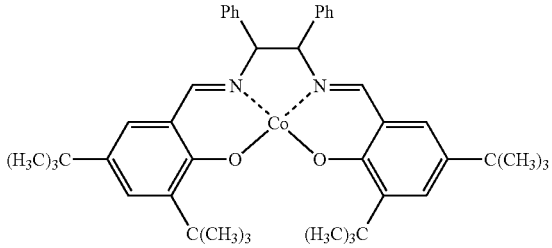

As the aluminoxane, for example, one obtained by bringing an organic aluminum compound (preferably a trimethyl aluminum) in contact with a condensation agent (preferably water), more specifically one having a structure represented by the following formula (7), may be used.

(7)

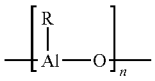

In the formula, R is a hydrocarbon group having 1 to 10 carbon atoms (preferably having 1 to 4 carbon atoms), and may be same or different in a neighboring constitutional unit, but preferably the same. The hydrocarbon group may be substituted with a halogen atom and/or an alkoxy group. n represents the degree of polymerization, and it is an integer of 4 to 20. R includes, for example, a methyl group, an ethyl group, a propyl group and an isobutyl group, and a methyl group is preferred. Examples of the organic aluminum compound used as a raw material of aluminoxane include a trialkyl aluminum such as trimethyl aluminum, triethyl aluminum, tributyl aluminum and a mixture thereof, prefereably the trimethyl aluminum. Further, aluminoxane comprising a mixture of trimethyl aluminum and tributyl aluminum as the raw material maybe used. In the present invention, in Formula (7), methylaluminoxane wherein R of all the constituent units are methyl groups is particularly preferred.

The high-cis/low-trans polydiene used in the present invention is not particularly limited as long as it is obtained by polymerization in the presence of the catalyst containing the metallosalen complex and the aluminoxane. The catalyst may further contain diethyl aluminum chloride ($Et_2AlCl$) and the like. In a preferred embodiment, the catalyst essentially consisting of the aforementioned metallosalen complex and the aluminoxane is used.

Examples of the diene used in the present invention include a conjugated diene such as 1,3-butadiene, 2-methyl-1,3-butadiene, 2-ethyl-1,3-butadiene, 2,3-dimethyl-1,3-butadiene, 1,3-pentadiene, 2-methyl-1,3-pentadiene, 4-methyl-1,3-pentadiene, 1,3-hexane diene and 2,4-hexadiene; particularly preferred is 1,3-butadiene.

In a polyhexadiene formed by polymerizing 2,4-hexadiene, cis-2,5-bond and trans-2,5-bond are formed. Herein, these cis-2,5-bond and trans-2,5-bond are assumed cis-1,4-bond and trans-1,4-bond respectively to calculate the content of cis-1,4-bond and trans-1,4-bond. Further, with regard to a diene having 6 or more carbon atoms, the rate of content of cis-1,4-bond and trans-1,4-bond is calculated in the same manner.

A method of polymerizing the diene in the presence of the catalyst containing the metallosalen complex and the aluminoxane is not particularly limited. The polymerization temperature, for example, is preferably 0° C. or more, more preferably 10° C. or more, and preferably 100° C. or less, more preferably 80° C. or less. The polymerization time is preferably 0.5 hour or more, more preferably 1 hour or more, and preferably 12 hours or less, more preferably 6 hours or less.

The amount of the metallosalen complex and the aluminoxane to be used is not particularly limited, but the metallosalen complex is preferably used in an amount of 0.01 part or more, more preferably 0.05 part or more, and preferably 2 parts or less, more preferably 1 part or less relative to 100 parts of the diene by mass. Further, the aluminoxane is preferably used in an amount of 1 part or more, more preferably 3 parts or more, and preferably 40 parts or less, more preferably 30 parts or less relative to 100 parts of the diene by mass.

The polymerization is preferably carried out in a solvent for dissolving the diene, the metallosalen complex and the aluminoxane. As the solvent, a halogenated solvent and a non-halogenated solvent may be used, and a halogenated solvent to which the metallosalen complex has high solubility is preferably used.

Examples of the halogenated solvent include mono, di or tri-halogen-substituted alkane such as methylene chloride, dichloromethane, chloroform, chloroethane, bromopropane, bromobutane, iodomethyl propane and fluoromethyl propane; and mono, di, or tri-halogen-substituted benzene such as chloro benzene, dichlorobenzene, bromobenzene, tribromobenzene, and iodobenzene. Among them, methylene chloride, dichloromethane and chloroform are preferred.

Examples of the non-halogenated solvent include an aromatic solvent such as benzene, toluene and nitrobenzene; an aliphatic hydrocarbon solvent such as pentane, hexane, heptane and octane; dimethyl formamide (DMF) and dimethyl acetamide (DMA).

Further, the catalytic activity can be enhanced by controlling the addition order of the metallosalen complex, the aluminoxane and the diene depending on the kind of metal of the metallosalen complex. For example, when using the cobalt salen complex, it is a preferred embodiment to add the cobalt salen complex into the diene before activating with the aluminoxane, and the yield of the resultant polymer can be enhanced by adding the materials in order as mentioned above. In the nickel salen complex, the influence of the addition order is hardly recognized.

The high-cis/low-trans polydiene used in the present invention preferably contains cis-1,4-bond in an amount of 90% or more, more preferably 96% or more, even more preferably 98% or more, yet more preferably 99% or more. Additionally, the polydiene preferably contains trans-1,4-bond in an amount of 1% or less, more preferably 0.8% or less, even more preferably 0.5% or less, further more preferably 0.3% or less. By increasing the content of cis-1,4-bond and reducing the content of trans-1,4-bond, a golf ball which is excellent in resilience and durability can be obtained. Therefore, the polydiene most preferably contains trans-1,4-bond in the amount of 0%.

Since the polydiene has the bonding type of 1,2-vinyl bond in addition to the cis-1,4-bond and the trans-1,4-bond, even if the content of the cis-1,4-bond is increased, it does not mean that the content of trans-1,4-bond is directly decreased. The present invention is characterized by a use of a polydiene having a high content of cis-1,4-bond and a low content of trans-1,4-bond. The content of trans-1,4-bond, cis-1,4-bond and 1,2-vinyl bond can be calculated by using $^{1}$H-NMR and $^{13}$C-NMR.

Herein, cis-1,4-bond, trans-1,4-bond and 1,2-vinyl bond are defined, for example, as follows in the polydiene represented by the following:

$$\text{cis-1,4-bond}(\%)=100\times X/(X+Y+Z)$$

$$\text{trans-1,4-bond}(\%)=100\times Y/(X+Y+Z)$$

$$\text{1,2-vinyl bond}(\%)=100\times Z/(X+Y+Z) \qquad \text{formula (8)}$$

(8)

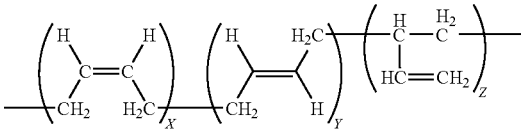

wherein X, Y, and Z represent the number of units of each constituent unit.

The rubber composition used in the present invention may contain, in addition to the abovementioned high-cis/low-trans polydiene, another rubber component as the base rubber, unless the effects of the present invention are deteriorated. Examples of the other rubber components may be one, two or more kinds among polybutadiene, ethylene-propylene-diene terpolymer (EPDM), isoprene rubber(IR), butyl rubber(IIR), natural rubber(NR), nitrile rubber(NBR), styrene rubber (SBR) and the like. Among them, preferably used is a high cis-polybutadiene containing a cis bond with advantageous resilience in an amount of 40% or more, more preferably 70% or more, even more preferably 90% or more, yet more preferably 96% or more.

The content of high-cis/low-trans polybutadiene in the base rubber is preferably 50% or more, more preferably 60% or more, even more preferably 70% or more. It is also a preferred embodiment that the base rubber to be used essentially consists of the high-cis/low-trans polydiene.

The co-crosslinking agent (b) contained in the rubber composition used in the present invention is not particularly limited as long as it has an action of crosslinking rubber molecules by graft polymerization to a rubber molecular chain, and such examples include an α,β-unsaturated carboxylic acid and/or a metal salt thereof. Examples of the metal constituting the metal salt include a monovalent metal and a divalent metal such as zinc, magnesium, calcium, or sodium.

Preferable examples are zinc or magnesium. Examples of the α,β-unsaturated carboxylic acid and/or the metal salt thereof include an α, β-unsaturated carboxylic acid having 3 to 8 carbon atoms and/or a metal salt thereof, more preferably acrylic acid, methacrylic acid, zinc acrylate, zinc methacrylate and the like. In addition, it is a preferred embodiment to use a multi-functional (meth)acrylate such as trimethylolpropanetrimethacrylate.

The content of the co-crosslinking agent (b) in the rubber composition is preferably 15 parts or more, more preferably 18 parts or more, even more preferably 22 parts or more relative to 100 parts of the base rubber by mass. If the content of the co-crosslinking agent is 15 parts or more by mass, the molded body obtained by molding the rubber composition can have an appropriate hardness. If the molded body is too soft, the deformation amount thereof when being hit may become so large that the shot feeling maybe lowered. Additionally, the content of the co-crosslinking agent (b) in the rubber composition is preferably 45 parts or less, more preferably 38 parts or less, even more preferably 30 parts or less relative to 100 parts of the base rubber by mass. By containing 45 parts or less of the co-crosslinking agent by mass, a preferable shot feeling can be obtained.

The crosslinking agent (c) contained in the rubber composition used in the present invention is blended to crosslink the base rubber component. As the crosslinking agent, an organic peroxide is preferably used, and such examples include dicumyl peroxide, 1,1-bis(t-butylperoxy)-3,5-trimethylcyclohexane, 2,5-dimethyl-2,5-di(t-butylperoxy)hexane and di-t-butyl peroxide. Among them, dicumyl peroxide is preferably used. The crosslinking agent is preferably blended in an amount of 0.2 part or more, more preferably 0.5 part or more, and is preferably blended in an amount of 5 parts or less, more preferably 3 parts or less relative to 100 parts of the base rubber by mass.

The rubber composition used in the present invention may contain, in addition to each of the above components, an organic sulfur compound. The content of the organic sulfur compound is preferably 0.05 part or more, more preferably 0.3 part or more and is preferably 5.0 parts or less, more preferably 3.0 parts or less relative to 100 parts of the base rubber by mass.

As the organic sulfur compound, diphenyl disulfide or a derivative thereof are preferably used. Examples of the diphenyl disulfide or the derivative thereof include diphenyl disulfide; a mono-substituted diphenyl disulfide such as bis(4-chlorophenyl)disulfide, bis(3-chlorophenyl)disulfide, bis(4-bromophenyl)disulfide, bis(3-bromophenyl)disulfide, bis(4-fluorophenyl)disulfide, bis(4-iodophenyl)disulfide, and bis(4-cyanophenyl)disulfide; a di-substituted diphenyl disulfide such as bis(2,5-dichlorophenyl)disulfide, bis(3,5-dichlorophenyl)disulfide, bis(2,6-dichlorophenyl)disulfide, bis(2,5-dibromophenyl)disulfide, bis(3,5-dibromophenyl)disulfide, bis(2-chloro-5-bromophenyl)disulfide, and bis(2-cyano-5-bromophenyl)disulfide; a tri-substituted diphenyl disulfide such as bis(2,4,6-trichlorophenyl)disulfide, and bis(2-cyano-4-chloro-6-bromophenyl)disulfide; a tetra substituted diphenyl disulfide such as bis(2,3,5,6-tetrachlorophenyl)disulfide; a penta substituted diphenyl disulfide such as bis(2,3,4,5,6-pentachlorophenyl)disulfide and bis(2,3,4,5,6-pentabromophenyl)disulfide. These diphenyl disulfide and the derivative thereof have some influence on the state of vulcanization of the vulcanized rubber body, and enhance the resilience thereof. Among them, in view of obtaining the golf ball having high resilience, diphenyl disulfide, or bis(pentabromophenyl)disulfide is particularly preferred.

The rubber composition used in the present invention may further include an additive such as a pigment; a filler for adjusting specific gravity and the like; an antioxidant, an anti-aging agent, a peptizing agent, and a softening agent in addition to the above base rubber, the co-crosslinking agent and the crosslinking agent.

The pigment which may be bended in the rubber composition, includes, for example, a white pigment, a blue-pigment, a violet-pigment and the like. Titanium oxide is preferably used as the white pigment. The type of the titanium oxide is not limited, but rutile titanium oxide is advantageously employed for its high opacifying properties. The amount of the titanium oxide is preferably 0.5 part or more, more preferably 2 parts or more, and is preferably 8 parts or less, more preferably 5 parts or less with respect to 100 parts by mass of the base rubber.

In a preferable embodiment, the rubber composition contains the white pigment and the blue pigment. The blue pigment is formulated to impart the bright whiteness to the golf ball. Examples of the blue pigment are, but are not limited to, ultramarine blue pigment, cobalt blue pigment, and phthalocyanine blue pigment. Examples of the violet pigment are, but are not limited to, anthraquinone violet pigment, dioxazine violet pigment, and methyl violet pigment.

The amount of the blue pigment is preferably not less than 0.001 part by mass, more preferably not less than 0.05 part by mass, and preferably not more than 0.2 part by mass, more preferably not more than 0.1 part by mass, with respect to 100 parts by mass of the rubber component. If the amount of the blue pigment is less than 0.001 part by mass, the resulting golf ball is insufficiently blue-colored and has a yellowish color. In contrast, if the amount of the blue pigment exceeds 0.2 part by mass, the resulting golf ball is excessively blue-colored and cannot significantly have a brightly white appearance.

The filler is blended as a gravity adjusting agent mainly used for adjusting the specific gravity of a one-piece golf ball obtained as a final product within the range of 1.0 to 1.5, and it may be blended if necessary. The filler may be one which is usually blended in the one-piece golf ball, for example, an inorganic filler (specifically zinc oxide, barium sulfate and calcium carbonate), a high gravity metal powder (e.g. tungsten powder and molybdenum powder) and a mixture thereof. Particularly preferred is zinc oxide which also serves as a vulcanization auxiliary agent. If zinc oxide is used, the content thereof is preferably 30 parts or less, more preferably 25 parts or less, even more preferably 15 parts or less relative to 100 parts of the base rubber by mass. If the content is more than 30 parts by mass, the content of the rubber component becomes too low to obtain high resilience.

The amount of the antioxidant to be blended in the rubber composition is preferably 0.1 part or more and 1 part or less relative to 100 parts of the base rubber by mass. Further, the amount of the peptizing agent is preferably 0.1 part or more and 5 parts or less relative to 100 parts by mass of the base rubber by mass.

The one-piece golf ball of the present invention is obtained by molding the rubber composition described above. The conditions for molding the rubber composition into the spherical molded body can be suitably determined depending on the rubber composition. The molding is usually carried out by heating the rubber composition at a temperature of 130° C. to 200° C. for 10 to 60 minutes. Alternatively, the molding is preferably carried out in a two-step heating, for 20 to 40 minutes at a temperature of 130° C. to 150° C. and continuously for 5 to 15 minutes at a temperature of 160° C. to 180° C.

The one-piece golf ball of the present invention has, a diameter of 42.67 mm or more, preferably 42.67 mm to 42.82 mm and a weight of 45.93 g or less, preferably 44.0 g to 45.8 g, based on the golf ball rule.

The one-piece golf ball of the present invention, if it has a diameter of 42.67 mm to 42.82 mm, preferably has a compression deformation amount (an amount the golf ball shrinks along the direction of the compression) of 2.3 mm or more, more preferably 2.4 mm or more, even more preferably 2.5 mm or more and preferably has a compression deformation amount of 3.0 mm or less, more preferably 2.8 mm or less, even more preferably 2.7 mm or less when applying a load from 98 N as an initial load to 1275 N as a final load. If the compression deformation amount is less than 2.3 mm, the shot feeling becomes bad due to hardness, while if it is more than 3.0 mm, the durability may be lowered.

In a preferred embodiment of the present invention, the surface hardness is larger than the center hardness. The difference of the hardness between the surface hardness and the center hardness of the one-piece golf ball is preferably 15 or more, more preferably 18 or more in shore D hardness. If the surface hardness of the one-piece golf ball is larger than the center hardness thereof, the launch angle becomes higher and the amount of spin becomes lowered, so that the flying distance is improved. The upper limit of the difference in shore D hardness between the surface hardness and the center hardness is not particularly limited, and is preferably 30, more preferably 25. If the difference of the hardness becomes too large, the durability tends to be lowered.

The center hardness of the one-piece golf ball is preferably 25 or more, more preferably 30 or more, even more preferably 32 or more in shore D hardness. If the center hardness of the one-piece golf ball is less than 25 in shore D hardness, the durability of the resultant one-piece golf ball may become lowered. Additionally, the center hardness of the one-piece golf ball is preferably 45 or less, more preferably 42 or less, even more preferably 40 or less in shore D hardness. If the center hardness is more than 45 in shore D hardness, the resultant one-piece golf ball becomes too hard, so that the shot feeling tends to be lowered. In the present invention, the center hardness of the one-piece golf ball means the hardness obtained by measuring at the central point of the cut surface when the one-piece golf ball is cut into halves with the Shore D type spring hardness tester.

The surface hardness of the one-piece golf ball of the present invention is preferably 45 or more, more preferably 50 or more, even more preferably 52 or more in shore D hardness. If the above hardness is less than 45, the resultant one-piece golf ball becomes so soft that the resilience may become lowered. Further, the surface hardness of the one-piece golf ball is preferably 70 or less, more preferably 65 or less, even more preferably 60 or less in shore D hardness. If the surface hardness is more than 70 in shore D hardness, the durability of the resultant golf ball may become lowered.

In the following, the method for preparing the golf ball of the present invention will be explained, but the present invention is not limited to the process explained below. First, (a) a base rubber, (b) a co-crosslinking agent and (c) a crosslinking agent, and, when necessary, further a filler and an additive are blended and kneaded to prepare a rubber composition. The resultant rubber composition is usually heated at a temperature of 130° C. to 200° C. for 10 to 60 minutes and molded into a spherical molded body. When the difference between the surface hardness and the center hardness is not made in the one-piece golf ball, the rubber composition is heated in a two-step; at a temperature of 130° C. to 150° C. for 20 to 40 minutes and continuously for 5 to 15 minutes at a temperature of 160° C. to 180° C. and molded into a molded body in a spherical shape. The resultant molded body in a spherical shape is usually formed with a plurality of concavities, which is so called "dimple", at the surface thereof. As required, the surface of the one-piece golf ball can be subjected to grinding treatment such as sandblast in order to improve the adhesion of the paint film.

EXAMPLES

The following examples illustrate the present invention, however these examples are intended to illustrate the invention and are not to be construed to limit the scope of the present invention. Many variations and modifications of such examples will exist without departing from the scope of the inventions. Such variations and modifications are intended to be within the scope of the invention.

[Evaluation Method]

(1) Repulsion Coefficient

A metal cylinder having a weight of 198.4 g was made collide with each one-piece golf ball at the speed of 40 m/sec to measure the speed of the above cylinder and each of the one-piece golf balls before and after the collisions. The repulsion coefficient of each of the one-piece golf balls was calculated from the speeds and the weights of the one-piece golf ball and the cylinder. The measurement of 12 golf balls was carried out for each one-piece golf ball, and the average was taken as the repulsion coefficient of the one-piece golf ball.

(2) Flying Distance

Each golf ball was hit at the head speed of 45 m/sec with a metal head wood club #1 (XXIO available from SRI Sports Limited, loft angle: 10°) attached to a swing robot produced by TRUETEMPER CO. to measure the flying distance (carry) to the point of fall. The measurement of 12 golf balls was carried out for each golf ball, and the average was taken as the result of the test. The flying distance was reduced to an index number relative to the value of golf ball No. 4 being assumed 100.

(3) Durability

Each golf ball was repeatedly hit with a metal head wood club #1 (XXIO available from SRI Sports Limited, loft angle: 10°) attached to a swing robot produced by TRUETEMPER CO, at the head speed of 45 m/sec. to make the golf ball collide with a collision board. Times up to which the golf balls are cracked were measured. In addition, each value obtained was reduced to an index number relative to the measured value obtained in Golf ball No. 4 being assumed 100. The larger number indicates better durability.

(4) Compression Deformation Amount (mm)

The compression deformation amount (amount the golf ball shrinks along the compression direction: mm) of the one-piece golf ball was measured when applying a load from 98N (10 kgf) as an initial load to 1275 N (130 kgf) as a final load to the one-piece golf ball.

(5) Method for Determining Cis, Trans and Vinyl Bond in polydiene

The ratio of 1,2-vinyl bond and (cis-1,4-bond+trans-1,4-bond) can be obtained using $^{1}$H-NMR (refer to FIG. 1). More specifically, in the $^{1}$H-NMR chart obtained by the measurement, the peaks in the vicinity of approximately 5.0 ppm and in the vicinity of approximately 5.4 ppm can be assigned to the peak of 1,2-vinyl bond and the peak of (cis-1,4-bond+trans-1,4-bond), respectively. Since the ratio of 1,2-vinyl bond and (cis-1,4-bond+trans-1,4-bond) is proportional to the area ratio of the peaks thereof, the ratio can be readily calculated.

Figure 2:
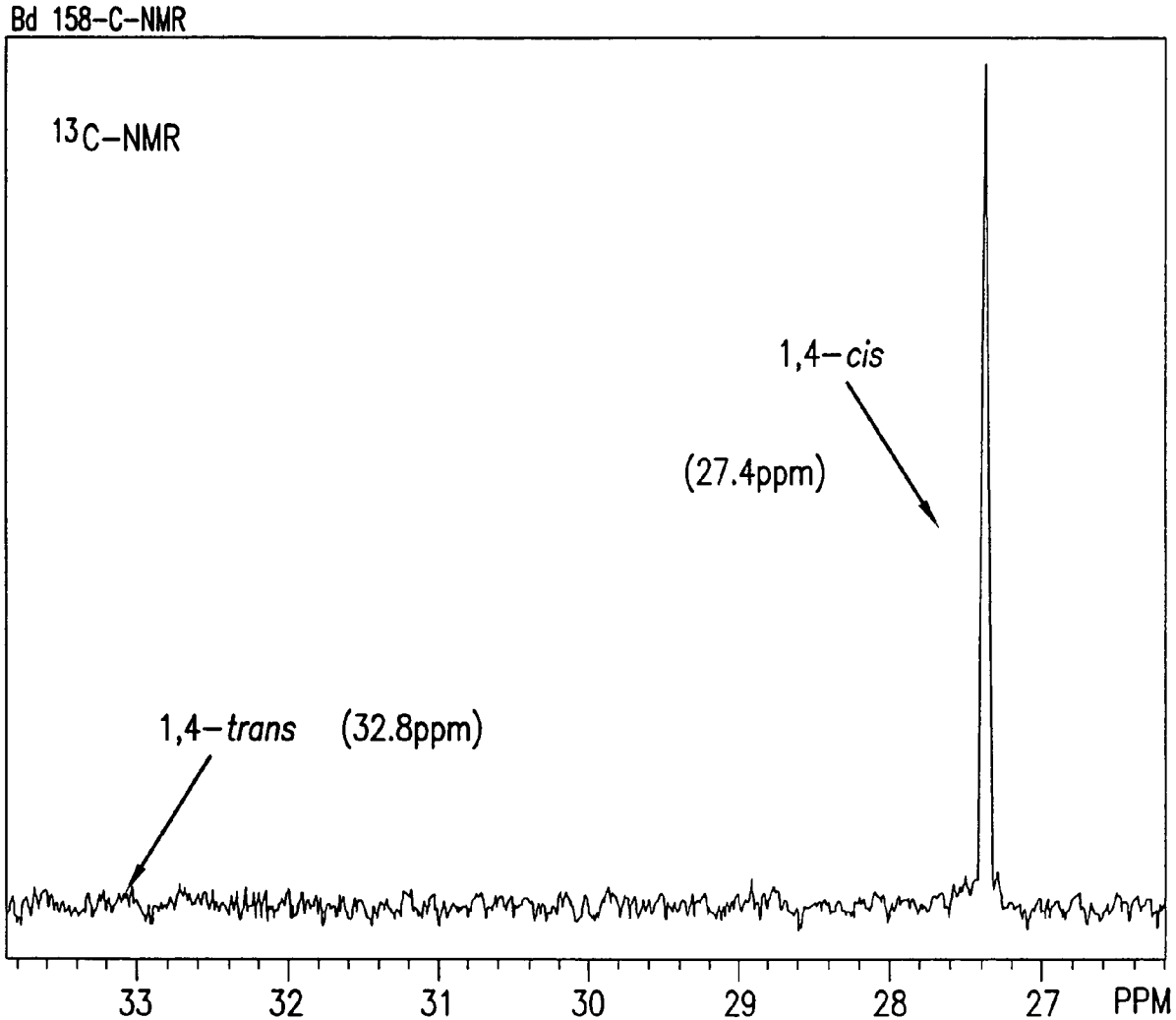
FIG. 2 is a $^{13}$C-NMR chart showing an example of the polybutadiene.

In addition, the ratio of cis-1,4-bond and trans-1,4-bond can be obtained using $^{13}$C-NMR (refer to FIG. 2). More specifically, in the $^{13}$C-NMR obtained by the measurement, the peak of 27 to 28 ppm and the peak in the vicinity of 33 ppm can be assigned to cis-1,4-bond and trans-1,4-bond, respectively. Since the ratio of cis-1,4-bond and trans-1,4-bond is proportional to the area ratio of the peaks thereof, the ratio can be readily calculated.

In the present invention, JOEL α-400NMR available from JEOL Ltd. was used for the measurement.

[Preparation of Metallosalen Complex]

Metallosalen Complex 1

15 g (0.064 mol) of 3,5-di-tert-butyl salicylaldehyde was dissolved in 500 ml of methanol, and then 1.92 g (0.032 mol) of ethylenediamine was added, and stirred at room temperature for 2 hours. The reaction product thus obtained was filtrated to give 13.3 g (0.0266 mol) of N,N'-bis(3,5-di-tert-butylsalicylidene)ethylenediamine. Next, in a solution obtained by dissolving the above compound in 1000 g of methanol, $Co(OAc)_2.4H_2O$ was added in an amount of 8.753 g (0.0266 mol), followed by reflux for two hours, and the product thus obtained was subjected to filtration to give a metallosalen complex 1 (N,N'-bis(3,5-di-tert-butylsalicylidene)ethylenediaminato cobalt(II)). The yield was 70%.

Metallosalen Complex 2

Except that 11.4 g (0.064 mol) of 3-tert-butylsalicylaldehyde was used instead of 15 g (0.064 mol) of 3,5-di-tert-butylsalicylaldehyde, metallosalen complex 2 (N,N'-bis(3-tert-butylsalicylidene)ethylenediaminato cobalt (II)) was obtained in the same manner as the metallosalen complex 1. The yield was 45%.

Metallosalen Complex 3

Except that 6.79 g (0.032 mol) of 1,2-diphenyl ethylenediamine was used instead of 1.92 g (0.032 mol) of ethylenediamine, metallosalen complex 3 (N,N'-bis(3,5-di-tert-butylsalicylidene)1,2-diphenylethylenediaminato cobalt(II)) was obtained in the same manner as the metallosalen complex 1. The yield was 60%.

[Preparation of polybutadiene Using a metallocene catalyst]

Interior of an autoclave having the capacity of 2 litter was displaced with nitrogen, and 2.5 mmole of bispentamethylcyclopentadienyelbistetrahydrofuran samarium was charged and dissolved into 1.5 L of toluene. Subsequently, Modified MAO(aluminoxane soluble in toluene, available from Tosoh Akzo Corporation) was added so that the atom ratio of aluminum and the samarium becomes 200 (Al/Sm=200). 400 mL of 1,3-butadiene was charged, and the polymerization was conducted at the temperature of 50° C. for 5 minutes. After the polymerization, 2.5 litter of methanol containing 10 mass % of 2,6-bis(t-butyl)-4-methylphenol was added to inhibit the reaction, and the resultant polymer was separated using a large amount of a mixed solution of methanol/hydrochloric acid and vacuum-dried at the temperature of 60° C. The yield of the polybutadiene thus obtained (hereinafter, in some case, may be referred to as "metallocene catalyst BR") was 65 mass % and the contents of each bond was shown in Table 1.

[Preparation of High-Cis/Low-Trans polybutadiene]

Interior of an autoclave having the capacity of 2 litter was displaced with nitrogen, and 1200 ml of methylene chloride was supplied, followed by charging of 150 ml of 1,3-butadiene therein. Then, the cobalt salen complex and the methylaluminoxane (MAO: Tosoh Akzo Corporation, FW=58.02) obtained as described above were added in this order so that the molar ratio of aluminum and the cobalt becomes 500 (MAO/Co=500). The polymerization was conducted at room temperature. The 1,3-butadiene, the metallosalen complex and the methylaluminoxane were charged in a ratio of 1,3-butadiene: metallosalen complex: methylaluminoxane=100:0.0558:27.9 (molar ratio). After the polymerization, 2 litter of methanol containing 10 mass % of BHT was added to inhibit the reaction, and the resultant polymer was separated using a large amount of a mixed solution of methanol/hydrochloric acid and vacuum-dried at the temperature of 60° C. The content of each of the bonds in the high-cis/low-trans polybutadiene thus obtained and a commercially available high cis-polybutadiene were measured, and the result is shown in Table 1.

TABLE 1

| | Catalyst | 1,3-Bd:Salen:MAO | | Molecular weight Weight | Molecular weight Number | Content of bond (% by mass) | | |
|---|---|---|---|---|---|---|---|---|
| Base rubber | Type | Molar ratio | Mass ratio | average | average | Trans-1,4 | Cis-1,4 | Vinyl-1,2 |
| BR11 | Ni-based catalyst | — | — | 690000 | 200000 | 1.3 | 98.2 | 0.5 |
| BR730 | Nd-based catalyst | — | — | 745000 | 267000 | 0.9 | 98.9 | 0.2 |
| Metallocene catalyst BR | Metallocene catalyst | — | — | 550000 | 170000 | 0.8 | 99 | 0.2 |
| High-cis/low-trans polybutadiene 1 | Metallo Salen complex 1 | 100:0.056:27.9 | 100:0.57:30 | 530000 | 160000 | 0.0 | 99 | 1.0 |
| High-cis/low-trans polybutadiene 2 | Metallo Salen complex 2 | 100:0.056:27.9 | 100:0.45:30 | 592000 | 164000 | 0.2 | 98.2 | 1.6 |
| High-cis/low-trans polybutadiene 3 | Metallo Salen complex 3 | 100:0.056:27.9 | 100:0.73:30 | 604000 | 173000 | 0.0 | 99.2 | 0.8 |

As apparent from the result shown in Table 1, a polybutadiene (high-cis/low-trans polybutadiene) obtained by polymerizing 1,3-butadiene in the presence of a catalyst containing the metallosalen complex and the methylaluminoxane is low in the content of trans-1,4 bond compared with a commercially available high cis-polybutadiene.

[Preparation of the One-Piece Golf Ball]

The rubber composition shown in Table 2 was kneaded by a kneading roll and then was subjected to heat-pressing in upper and lower molds having spherical cavities at the temperature of 170° C. for 17 minutes to obtain a one-piece golf ball body. The surface of the obtained one-piece golf ball body was subjected to the sand-blast treatment, the mark was printed, and then the clear paint was coated and dried in an oven kept at 40° C. to obtain the golf ball having a diameter of 42.8 mm and a mass of 45.4 g. The evaluation results of the resultant one-piece golf balls with regard to compression deformation amount, repulsion coefficient, flying distance and durability are collectively shown in Table 2.

TABLE 2

| | Golf ball No. | | | | | | | |
|---|---|---|---|---|---|---|---|---|
| | No. 1 | No. 2 | No. 3 | No. 4 | No. 5 | No. 6 | No. 7 | No. 8 |
| Golf ball body composition | — | — | — | — | — | — | — | — |
| BR11 | — | — | — | 50 | — | 100 | — | — |
| BR730 | — | — | — | — | — | — | 100 | — |
| Metallocene catalyst BR | — | — | — | — | — | — | — | 100 |
| High-cis/low-trans polybutadiene 1 | 100 | — | — | — | — | — | — | — |
| High-cis/low-trans polybutadiene 2 | — | 100 | — | — | — | — | — | — |
| High-cis/low-trans polybutadiene 3 | — | — | 100 | 50 | 100 | — | — | — |
| Metacrylic acid | 24 | 24 | 24 | 24 | 24 | 24 | 24 | 24 |
| Zinc oxide | 24 | 24 | 24 | 24 | 24 | 24 | 24 | 24 |
| Dicumyl peroxide | 0.5 | 0.5 | 0.5 | 0.5 | 0.5 | 0.5 | 0.5 | 0.5 |
| Diphenyl disulfide | — | — | — | — | 0.25 | — | — | — |
| Pigment | 0.06 | 0.06 | 0.06 | 0.06 | 0.06 | 0.06 | 0.06 | 0.06 |
| Properties of Golf ball | — | — | — | — | — | — | — | — |
| Center hardness (Shore D) | 36 | 37 | 36 | 37 | 36 | 37 | 37 | 36 |
| Surface hardness (Shore D) | 57 | 57 | 58 | 57 | 59 | 56 | 56 | 56 |
| Difference of hardness (Shore D) | 21 | 20 | 22 | 20 | 23 | 19 | 19 | 20 |
| Compression deformation amount (mm) | 2.55 | 2.56 | 2.54 | 2.56 | 2.58 | 2.60 | 2.59 | 2.58 |
| Repulsion coefficient | 0.725 | 0.724 | 0.726 | 0.723 | 0.727 | 0.720 | 0.721 | 0.722 |
| Flying distance of driver | 101 | 100 | 102 | 100 | 104 | 97 | 98 | 99 |
| Durability | 104 | 100 | 112 | 100 | 117 | 94 | 94 | 96 |

Formulation (parts by mass)
Notes on Table 2
Polybutadiene rubber: BR11 and BR730 (content of cis: 96% or more) produced by JSR
Methacrylic acid: Methacrylic acid available from Mitsubishi Rayon CO., LTD.
Zinc oxide: "Ginrei R" produced by Toho-Zinc.
Dicumyl peroxide: Percumyl D produced by NOF Corporation
Diphenyl disulfide: produced by Sumitomo Seika Chemicals Company Limited As apparent from Table 2, golf balls Nos. 1 to 5 of the present invention using high-cis/low-trans polybutadiene have proven to be excellent in resilience (flying distance) and durability. In addition, the one-piece golf ball of the present invention is more excellent in the resilience and durability that the golf ball using the high-cis polybutadiene synthesized in the presence of the metallocene catalyst.

The present invention is suitable for the one-piece golf ball. This application is based on Japanese Patent application No. 2,006-184,880 filed on Jul. 4, 2006, the contents of which are hereby incorporated by reference.

What is claimed is:

1. A one-piece golf ball obtained by molding a rubber composition which comprises:

(a) a base rubber containing a polybutadiene obtained by polymerizing butadiene in the presence of a catalyst containing a cobalt salen complex and methylaluminoxane;

(b) a co-crosslinking agent; and (c) a crosslinking agent, and the polybutadiene contains 98% or more of cis-1,4-bond and 1% or less of trans-1,4-bond, and the one-piece golf ball having a compression deformation amount of 2.3 mm or more, and 3.0 mm or less when applying a load from 98 N as an initial toad to 1275 N as a final load, the difference of the hardness between the surface hardness and the center hardness being 15 or more, 30 or less in shore D hardness, the center hardness being 25 or more, 45 or less in shore D hardness, and the surface hardness being 45 or more, 70 or less in shore D hardness.

2. The one-piece golf ball according to claim 1, wherein the polybutadiene contains 0.5% or less of the trans-1,4-bond.

3. The one-piece golf ball according to claim 2, wherein the butadiene is a butadiene selected from the group consisting of 1,3-butadiene, 2-methyl-1,3-butadiene, 2-ethyl-1,3-butadiene, 2,3-dimethyl-1,3-butadiene.

4. The one-piece golf ball according to claim 2, wherein the butadiene is 1,3-butadiene.

5. The one-piece golf ball according to claim 4, wherein the cobalt salen complex is at least one member selected from the group consisting of N,N'-bis(3-tert-butylsalicylidene)ethylenediaminato Cobalt(II), N,N'-bis(3-tert-butyl-5-methylsalicylidene)ethylenediaminato Cobalt(II), N,N'-bis(3,5-di-tert-butylsalicylidene)ethylenediaminato Cobalt(II), and N,N'-bis(3,5-di-tert-butylsalicylidene) 1,2-diphenylethylenediaminato Cobalt(II).

6. The one-piece golf ball according to claim 5, wherein the rubber composition contains:

(b) 15 parts to 45 parts of the co-crosslinking agent by mass, and (c) 0.2 part to 5 parts of the crosslinking agent by mass, relative to 100 parts by mass of (a) the base rubber.

7. The one-piece golf ball according to claim 6, wherein the polybutadiene contains 0.3% or less of the trans-1,4-bond.

* * * * *